US010288363B2

(12) United States Patent
Matsui et al.

(10) Patent No.: US 10,288,363 B2
(45) Date of Patent: May 14, 2019

(54) LAMINATED HEADER, HEAT EXCHANGER, AND AIR-CONDITIONING APPARATUS

(71) Applicant: Mitsubishi Electric Corporation, Tokyo (JP)

(72) Inventors: Shigeyoshi Matsui, Tokyo (JP); Shinya Higashiiue, Tokyo (JP); Takashi Okazaki, Tokyo (JP); Akira Ishibashi, Tokyo (JP); Daisuke Ito, Tokyo (JP); Atsushi Mochizuki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 342 days.

(21) Appl. No.: 14/910,308

(22) PCT Filed: Sep. 26, 2013

(86) PCT No.: PCT/JP2013/076128
§ 371 (c)(1),
(2) Date: Feb. 5, 2016

(87) PCT Pub. No.: WO2015/045073
PCT Pub. Date: Apr. 2, 2015

(65) Prior Publication Data

US 2016/0178292 A1 Jun. 23, 2016

(51) Int. Cl.
*F28F 9/02* (2006.01)
*F28F 3/08* (2006.01)
(Continued)

(52) U.S. Cl.
CPC ..... *F28F 9/0265* (2013.01); *F25B 13/00* (2013.01); *F25B 39/022* (2013.01); *F28F 3/086* (2013.01);
(Continued)

(58) Field of Classification Search
CPC ..... F28F 9/026; F28F 9/0278; F28F 9/0275; F28F 9/0221; F28F 9/02693
See application file for complete search history.

(56) References Cited

U.S. PATENT DOCUMENTS 4,502,297 A * 3/1985 Winterer ..... F25B 39/02 165/168
5,241,839 A * 9/1993 Hughes ..... B60H 1/3227 165/174
(Continued)

FOREIGN PATENT DOCUMENTS

EP 3018441 A1 5/2016
JP 06-011291 A 1/1994
(Continued)

OTHER PUBLICATIONS

International Search Report of the International Searching Authority dated Jan. 7, 2014 for the corresponding International application No. PCT/JP2013/076128 (and English translation).
(Continued)

*Primary Examiner* — Frantz F Jules
*Assistant Examiner* — Lionel Nouketcha
(74) *Attorney, Agent, or Firm* — Posz Law Group, PLC

(57) ABSTRACT

A laminated header according to the present invention includes: a first plate-like body having a plurality of first outlet flow passages formed therein; and a second plate-like body laminated on the first plate-like body, the second plate-like body having a distribution flow passage formed therein, the distribution flow passage being configured to distribute refrigerant, which passes through a first inlet flow passage to flow into the second plate-like body, to the plurality of first outlet flow passages to cause the refrigerant to flow out from the second plate-like body. A branching flow passage of the distribution flow passage includes: a branching portion; an inflow passage extending toward the
(Continued)

branching portion; and a plurality of outflow passages extending from the branching portion in directions different from each other. Curvature radii of bending portions of the plurality of outflow passages are different from each other.

8 Claims, 5 Drawing Sheets

(51) Int. Cl.

| | |
|---|---|
| ***F25B 13/00*** | (2006.01) |
| ***F25B 39/02*** | (2006.01) |
| *F28D 1/047* | (2006.01) |
| *F28F 1/32* | (2006.01) |
| *F28D 21/00* | (2006.01) |

(52) U.S. Cl.
CPC ..... *F28F 9/0221* (2013.01); *F28F 9/0275* (2013.01); *F28F 9/0278* (2013.01); *F28D 1/0475* (2013.01); *F28D 2021/0063* (2013.01); *F28D 2021/0064* (2013.01); *F28F 1/32* (2013.01)

(56) References Cited

U.S. PATENT DOCUMENTS 5,242,016 A * 9/1993 Voss ..... F25B 39/028 165/173
6,616,327 B1 * 9/2003 Kearney ..... B01F 5/06 366/340
6,892,805 B1 * 5/2005 Valensa ..... F28F 9/0278 165/173
8,051,902 B2 * 11/2011 Kappes ..... F28F 7/02 165/174

FOREIGN PATENT DOCUMENTS

| | | | | |
|---|---|---|---|---|
| JP | 07-017951 | Y | | 4/1995 |
| JP | 11-118295 | A | | 4/1999 |
| JP | 11118295 | A | * | 4/1999 |
| JP | 2000-161818 | A | | 6/2000 |
| JP | 2006-125652 | A | | 5/2006 |

OTHER PUBLICATIONS

Office Action dated Dec. 30, 2016 issued in corresponding CN patent application No. 201380079149.7 (and English translation).
Office Action dated Aug. 23, 2016 for the corresponding JP application No. 2015-538714 (and English translation).

Extended European Search Report dated Jun. 2, 2017 issued in corresponding EP patent application No. 13894592.8.

* cited by examiner

LAMINATED HEADER, HEAT EXCHANGER, AND AIR-CONDITIONING APPARATUS

CROSS REFERENCE TO RELATED APPLICATION

This application is a U.S. national stage application of International Application No. PCT/JP2013/076128 filed on Sep. 26, 2013, the disclosure of which is incorporated herein by reference.

TECHNICAL FIELD

The present invention relates to a laminated header, a heat exchanger, and an air-conditioning apparatus.

BACKGROUND ART

As a related-art laminated header, there is known a laminated header including a first plate-like body having a plurality of outlet flow passages formed therein, and a second plate-like body laminated on the first plate-like body and having a distribution flow passage formed therein so as to distribute refrigerant, which passes through an inlet flow passage to flow into the second plate-like body, to the plurality of outlet flow passages formed in the first plate-like body to cause the refrigerant to flow out from the second plate-like body. The distribution flow passage includes a branching flow passage having a plurality of grooves extending radially in a direction perpendicular to a refrigerant inflow direction. The refrigerant passing through the inlet flow passage to flow into the branching flow passage passes through the plurality of grooves to be branched into a plurality of flows, to thereby pass through the plurality of outlet flow passages formed in the first plate-like body to flow out from the first plate-like body (for example, see Patent Literature 1).

CITATION LIST

Patent Literature

Patent Literature: Japanese Unexamined Patent Application Publication No. 2000-161818 (paragraph [0012] to paragraph [0020], FIG. 1, FIG. 2)

SUMMARY OF INVENTION

Technical Problem

In such a laminated header, a ratio of flow rates of respective flows of the refrigerant flowing out from the plurality of outlet flow passages, that is, a distribution ratio is determined depending on a usage situation, a usage environment, or other usage conditions of the laminated header. For example, when the laminated header is used under a situation where the inflow direction of the refrigerant flowing into the branching flow passage is not parallel to the gravity direction, the refrigerant may be affected by the gravity to cause a deficiency or an excess of the refrigerant in any of the branching directions. Due to the fact that the distribution ratio cannot be set, the flow rates of the respective flows of the refrigerant flowing out from the plurality of outlet flow passages cannot be kept uniform. In other words, the related-art laminated header has a problem in that the distribution ratio cannot be set, thereby hindering the use of the laminated header under a variety of situations, environments, or other conditions.

The present invention has been made in view of the problem as described above, and therefore has an object to provide a laminated header that can be used under a variety of situations, environments, or other conditions. Further, the present invention has an object to provide a heat exchanger including the laminated header as described above. Still further, the present invention has an object to provide an air-conditioning apparatus including the heat exchanger as described above.

Solution to Problem

According to one embodiment of the present invention, there is provided a laminated header, including: a first plate-like body having a plurality of first outlet flow passages formed therein; and a second plate-like body laminated on the first plate-like body, the second plate-like body having a distribution flow passage formed therein, the distribution flow passage being configured to distribute refrigerant, which passes through a first inlet flow passage to flow into the second plate-like body, to the plurality of first outlet flow passages to cause the refrigerant to flow out from the second plate-like body, in which the distribution flow passage includes at least one branching flow passage, in which the at least one branching flow passage includes: a branching portion; an inflow passage extending toward the branching portion; and a plurality of outflow passages extending from the branching portion in directions different from each other, in which each of at least two outflow passages of the plurality of outflow passages has one bending portion or a plurality of bending portions formed therein, and in which a curvature radius of the one bending portion formed in one outflow passage of the at least two outflow passages or a curvature radius of a bending portion having a largest bending angle among the plurality of bending portions formed in the one outflow passage of the at least two outflow passages is different from a curvature radius of the one bending portion formed in at least one outflow passage different from the one outflow passage of the at least two outflow passages or a curvature radius of a bending portion having a largest bending angle among the plurality of bending portions formed in the at least one outflow passage different from the one outflow passage of the at least two outflow passages.

Advantageous Effects of Invention

In the laminated header according to the one embodiment of the present invention, the distribution ratio can be appropriately set through adjustment of the curvature radius of the one bending portion or the plurality of bending portions formed in the outflow passage of the branching flow passage. Thus, the laminated header can be used even under a variety of situations, environments, or other conditions.

DESCRIPTION OF EMBODIMENTS

Figure 1:
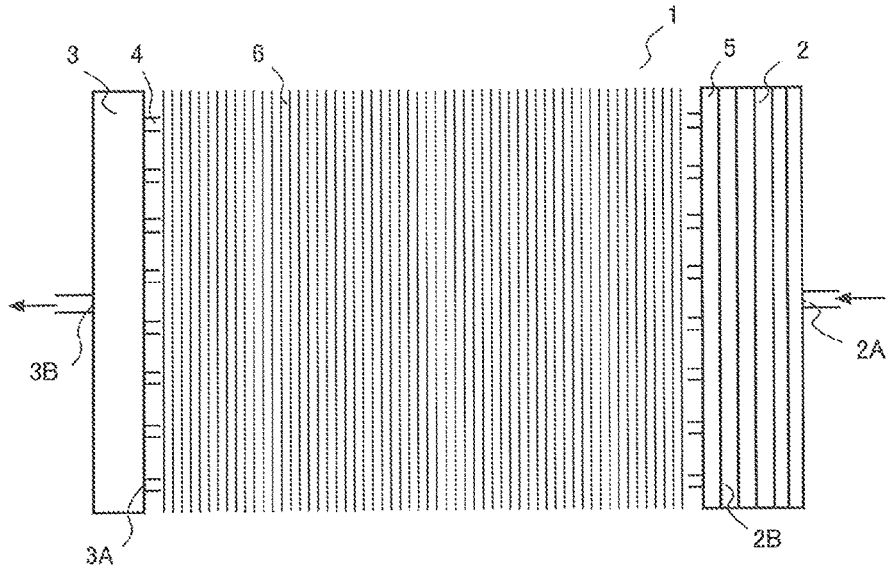
FIG. 1 is a view for illustrating a configuration of a heat exchanger according to Embodiment 1.

Now, a laminated header according to the present invention is described with reference to the drawings.

Note that, in the following, there is described a case where the laminated header according to the present invention distributes refrigerant flowing into a heat exchanger, but the laminated header according to the present invention may distribute refrigerant flowing into other devices. Further, the configuration, operation, and other matters described below are merely examples, and the laminated header according to the present invention is not limited to such configuration, operation, and other matters. Further, in the drawings, the same or similar components are denoted by the same reference symbols, or the reference symbols therefor are omitted. Further, the illustration of details in the structure is appropriately simplified or omitted. Further, overlapping description or similar description is appropriately simplified or omitted.

Embodiment 1

A heat exchanger according to Embodiment 1 is described.

<Configuration of Heat Exchanger>

Now, the configuration of the heat exchanger according to Embodiment 1 is described.

FIG. 1 is a view for illustrating the configuration of the heat exchanger according to Embodiment 1.

As illustrated in FIG. 1, a heat exchanger 1 includes a laminated header 2, a header 3, a plurality of first heat transfer tubes 4, a retaining member 5, and a plurality of fins 6.

The laminated header 2 includes a refrigerant inflow port 2A and a plurality of refrigerant outflow ports 2B. The header 3 includes a plurality of refrigerant inflow ports 3A and a refrigerant outflow port 3B. Refrigerant pipes are connected to the refrigerant inflow port 2A of the laminated header 2 and the refrigerant outflow port 3B of the header 3. The first heat transfer tubes 4 are connected between the refrigerant outflow ports 2B of the laminated header 2 and the refrigerant inflow ports 3A of the header 3.

The first heat transfer tube 4 is a flat tube having a plurality of flow passages formed therein. The first heat transfer tube 4 is made of, for example, aluminum. End portions of the first heat transfer tubes 4 on the laminated header 2 side are connected to the refrigerant outflow ports 2B of the laminated header 2 under a state in which the end portions are retained by the plate-like retaining member 5. The retaining member 5 is made of, for example, aluminum. The plurality of fins 6 are joined to the first heat transfer tubes 4. The fin 6 is made of, for example, aluminum. Note that, in FIG. 1, there is illustrated a case where eight first heat transfer tubes 4 are provided, but the present invention is not limited to such a case. For example, two first heat transfer tubes 4 may be provided. Further, the first heat transfer tube 4 need not be the flat tube.

<Flow of Refrigerant in Heat Exchanger>

Now, the flow of the refrigerant in the heat exchanger according to Embodiment 1 is described.

The refrigerant flowing through the refrigerant pipe passes through the refrigerant inflow port 2A to flow into the laminated header 2 to be distributed, and then passes through the plurality of refrigerant outflow ports 2B to flow out toward the plurality of first heat transfer tubes 4. In the plurality of first heat transfer tubes 4, the refrigerant exchanges heat with, for example, air supplied by a fan. The refrigerant flowing through the plurality of first heat transfer tubes 4 passes through the plurality of refrigerant inflow ports 3A to flow into the header 3 to be joined, and then passes through the refrigerant outflow port 3B to flow out toward the refrigerant pipe. The refrigerant can reversely flow.

<Configuration of Laminated Header>

Now, the configuration of the laminated header of the heat exchanger according to Embodiment 1 is described.

Figure 2:
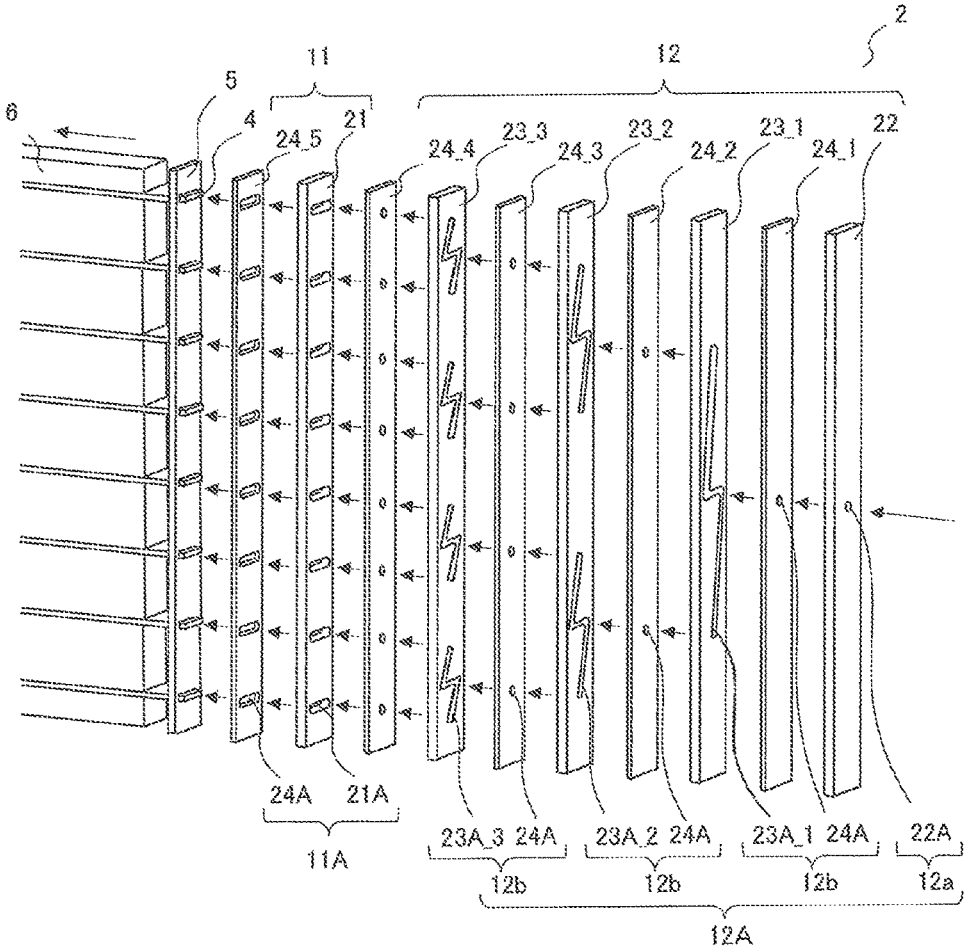
FIG. 2 is a perspective view for illustrating the heat exchanger according to Embodiment 1 under a state in which a laminated header is disassembled.

FIG. 2 is a perspective view of the heat exchanger according to Embodiment 1 under a state in which the laminated header is disassembled.

As illustrated in FIG. 2, the laminated header 2 includes a first plate-like body 11 and a second plate-like body 12. The first plate-like body 11 is laminated on the refrigerant outflow side. The second plate-like body 12 is laminated on the refrigerant inflow side.

The first plate-like body 11 includes a first plate-like member 21 and a cladding member 24_5. The second plate-like body 12 includes a second plate-like member 22, a plurality of third plate-like members 23_1 to 23_3, and a plurality of cladding members 24_1 to 24_4. A brazing material is applied to one or both surfaces of each of the cladding members 24_1 to 24_5. The first plate-like member 21 is laminated on the retaining member 5 through intermediation of the cladding member 24_5. The plurality of third plate-like members 23_1 to 23_3 are laminated on the first plate-like member 21 through intermediation of the cladding members 24_2 to 24_4, respectively. The second plate-like member 22 is laminated on the third plate-like member 23_1 through intermediation of the cladding member 24_1. For example, each of the first plate-like member 21, the second plate-like member 22, and the third plate-like members 23_1 to 23_3 has a thickness of from about 1 mm to about 10 mm, and is made of aluminum. In the following, in some cases, the retaining member 5, the first plate-like member 21, the second plate-like member 22, the third plate-like members 23_1 to 23_3, and the cladding members 24_1 to 24_5 are collectively referred to as the plate-like member. Further, in some cases, the third plate-like members 23_1 to 23_3 are collectively referred to as the third plate-like member 23. Still further, in some cases, the cladding members 24_1 to 24_5 are collectively referred to as the cladding member 24. The third plate-like member 23 corresponds to a "first plate-like member" of the present invention. Each of the cladding members 24_1 to 24_4 corresponds to a "second plate-like member" of the present invention.

A plurality of first outlet flow passages 11A are formed by flow passages 21A formed in the first plate-like member 21 and flow passages 24A formed in the cladding member 24_5. Each of the flow passages 21A and the flow passages 24A is a through hole having an inner peripheral surface shaped conforming to an outer peripheral surface of the first heat transfer tube 4. The end portions of the first heat transfer tubes 4 are joined to the retaining member 5 by brazing to be retained. When the first plate-like body 11 and the retaining member 5 are joined to each other, the end portions of the first heat transfer tubes 4 and the first outlet flow passages 11A are connected to each other. The first outlet flow passages 11A and the first heat transfer tubes 4 may be joined to each other without providing the retaining member 5. In such a case, the component cost and the like are reduced. The plurality of first outlet flow passages 11A correspond to the plurality of refrigerant outflow ports 2B in FIG. 1.

A distribution flow passage 12A is formed by a flow passage 22A formed in the second plate-like member 22, flow passages 23A_1 to 23A_3 formed in the third plate-like members 23_1 to 23_3, and flow passages 24A formed in the cladding members 24_1 to 24_4. The distribution flow passage 12A includes a first inlet flow passage 12*a* and a plurality of branching flow passages 12*b*. In the following, in some cases, the flow passages 23A_1 to 23A_3 are collectively referred to as the flow passage 23A.

The first inlet flow passage 12*a* is formed by the flow passage 22A formed in the second plate-like member 22. The flow passage 22A is a circular through hole. The refrigerant pipe is connected to the first inlet flow passage 12*a*. The first inlet flow passage 12*a* corresponds to the refrigerant inflow port 2A in FIG. 1.

The branching flow passage 12*b* is formed by the flow passage 23A formed in the third plate-like member 23 and the flow passage 24A formed in the cladding member 24 laminated on the surface of the third plate-like member 23 on the refrigerant inflow side. The flow passage 23A is a linear through groove. The flow passage 24A is a circular through hole. Details of the branching flow passage 12*b* are described later.

A part between the end portions of the flow passage 23A formed in the third plate-like member 23 and the flow passage 24A formed in the cladding member 24 laminated on the surface of the third plate-like member 23 on the refrigerant inflow side are formed at positions opposed to each other. Therefore, the flow passage 23A formed in the third plate-like member 23 is closed by the cladding member 24 laminated on the surface of the third plate-like member 23 on the refrigerant inflow side, except for the part between the end portions of the flow passage 23A. Further each of the end portions of the flow passage 23A formed in the third plate-like member 23 and the flow passage 24A formed in the cladding member 24 laminated on the surface of the third plate-like member 23 on the refrigerant outflow side are formed at positions opposed to each other. Therefore, the flow passage 23A formed in the third plate-like member 23 is closed by the cladding member 24 laminated on the surface of the third plate-like member 23 on the refrigerant outflow side, except for the end portions of the flow passage 23A.

Note that, a plurality of distribution flow passages 12A may be formed in the second plate-like body 12, and each of the distribution flow passages 12A may be connected to a part of the plurality of first outlet flow passages 11A formed in the first plate-like body 11. Further, the first inlet flow passage 12*a* may be formed in a plate-like member other than the second plate-like member 22. In other words, the present invention encompasses a case where the first inlet flow passage 12*a* is formed in the first plate-like body 11, and the "distribution flow passage" of the present invention encompasses a distribution flow passage other than the distribution flow passage 12A having the first inlet flow passage 12*a* formed in the second plate-like body 12.

<Flow of Refrigerant in Laminated Header>

Now, the flow of the refrigerant in the laminated header of the heat exchanger according to Embodiment 1 is described.

The refrigerant passing through the first inlet flow passage 12*a* flows into the branching flow passage 12*b*. In the branching flow passage 12*b*, the refrigerant passing through the flow passage 24A flows into the part between the end portions of the flow passage 23A, and hits against the surface of the cladding member 24 laminated adjacent to the third plate-like member 23 having the flow passage 23A formed therein so that the refrigerant is branched into two flows. The refrigerant reaches each of both the end portions of the flow passage 23A, and flows into the subsequent branching flow passage 12*b*. The refrigerant that undergoes this process repeated a plurality of times flows into each of the plurality of first outlet flow passages 11A, and flows out toward each of the plurality of first heat transfer tubes 4.

<Details of Branching Flow Passage>

Now, details of the branching flow passage of the laminated header of the heat exchanger according to Embodiment 1 are described.

Figure 3:
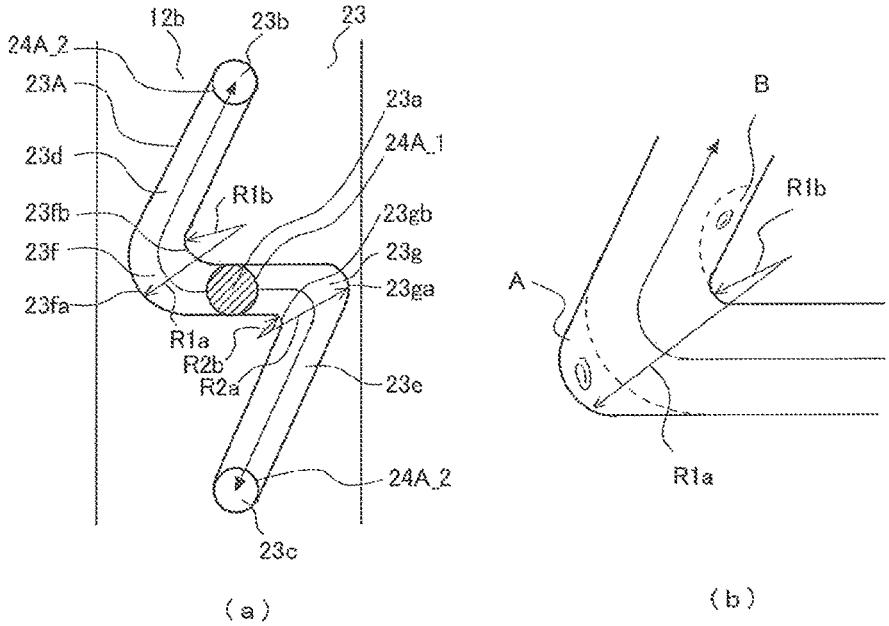
FIG. 3 is a set of front view of a periphery of a branching flow passage of the heat exchanger according to Embodiment 1, and an explanatory view of a state of refrigerant at a part of the branching flow passage.

FIG. 3 is a set of front view of a periphery of the branching flow passage of the heat exchanger according to Embodiment 1, and an explanatory view of a state of the refrigerant at a part of the branching flow passage.

Note that, in FIG. 3(*a*), the flow passage 24A formed in the cladding member 24 laminated on the surface on the refrigerant inflow side of the third plate-like member 23 having the flow passage 23A formed therein is denoted by 24A_1, whereas the flow passage 24A formed in the cladding member 24 laminated on the surface on the refrigerant outflow side is denoted by 24A_2. Further, in FIG. 3(*b*), a state of the refrigerant at a first bending portion 23*f* is illustrated, and a state of the refrigerant at a second bending portion 23*g* is similar to the state illustrated in FIG. 3(*b*).

As illustrated in FIG. 3(*a*), the branching flow passage 12*b* includes a branching portion 23*a*, which is a region in the flow passage 23A opposed to the flow passage 24A_1, the flow passage 24A_1 communicated with the branching portion 23*a*, a first outflow passage 23*d* communicating the branching portion 23*a* and an upper end portion 23*b* of the flow passage 23A, and a second outflow passage 23*e* communicating the branching portion 23*a* and a lower end portion 23*c* of the flow passage 23A. The flow passage 24A_1 corresponds to an "inflow passage" of the present invention.

In order that the refrigerant flowing into the branching flow passage 12*b* may be branched at different heights to flow out therefrom, the upper end portion 23*b* is positioned above the branching portion 23*a* in the gravity direction, whereas the lower end portion 23*c* is positioned below the branching portion 23*a* in the gravity direction. A straight line connecting the upper end portion 23*b* and the lower end portion 23*c* is set parallel to a longitudinal direction of the third plate-like member 23, thereby being capable of reducing the dimension of the third plate-like member 23 in its transverse direction. As a result, the component cost, the weight, and the like are reduced. Further, the straight line connecting the upper end portion 23*b* and the lower end portion 23*c* is set parallel to an array direction of the first heat transfer tubes 4, thereby achieving space saving in the heat exchanger 1. Note that, the straight line connecting the upper end portion 23*b* and the lower end portion 23*c*, the longitudinal direction of the third plate-like member 23, and the array direction of the first heat transfer tubes 4 need not be parallel to the gravity direction.

The first bending portion 23*f* is formed in the first outflow passage 23*d*. The second bending portion 23*g* is formed in the second outflow passage 23*e*. A region in the flow passage 23A between the branching portion 23*a* and the first bending portion 23*f* and a region in the flow passage 23A between the branching portion 23*a* and the second bending portion 23*g* are formed into a straight line shape perpendicular to the gravity direction. With this configuration, the angles of the respective branching directions with respect to the gravity direction at the branching portion 23*a* are kept uniform, thereby being capable of suppressing the influence of the gravity on the distribution of the refrigerant.

A curvature radius R1*a* of an outer wall surface 23*fa* of the first bending portion 23*f* and a curvature radius R2*a* of an outer wall surface 23*ga* of the second bending portion 23*g* are different from each other. A curvature radius R1*b* of an inner wall surface 23*fb* of the first bending portion 23*f* and a curvature radius R2*b* of an inner wall surface 23*gb* of the second bending portion 23*g* are different from each other. In the following, in some cases, the curvature radius R1*a* of the outer wall surface 23*fa* and the curvature radius R2*a* of the outer wall surface 23*ga* are collectively referred to as the curvature radius Ra of the outer wall surface. Further, in some cases, the curvature radius R1*b* of the inner wall surface 23*fb* and the curvature radius R2*b* of the inner wall surface 23*gb* are collectively referred to as the curvature radius Rb of the inner wall surface.

As described above, the flow passage 23A is formed so that the curvature radius of the first bending portion 23*f* and the curvature radius of the second bending portion 23*g* are different from each other. Thus, the pressure loss occurring in the refrigerant flowing through the first outflow passage 23*d* and the pressure loss occurring in the refrigerant flowing through the second outflow passage 23*e* are changed, thereby adjusting a distribution ratio of the respective flows of the refrigerant flowing out from the plurality of first outlet flow passages 11A.

That is, as illustrated in FIG. 3(*b*), a vortex is generated in a region A located on the inner side of each of the outer wall surfaces 23*fa* and 23*ga* of the first bending portion 23*f* and the second bending portion 23*g*. A vortex is also generated in a region B located on the downstream side of each of the inner wall surfaces 23*fb* and 23*gb*. The vortex causes a pressure loss in the refrigerant passing through each of the first bending portion 23*f* and the second bending portion 23*g*.

Figure 4:
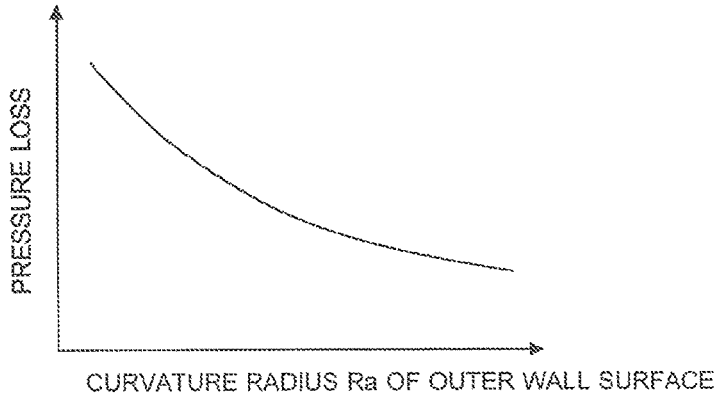
FIG. 4 is a graph for showing a relationship between a curvature radius of an outer wall surface and a pressure loss.

FIG. 4 is a graph for showing a relationship between the curvature radius of the outer wall surface and the pressure loss.

Figure 5:
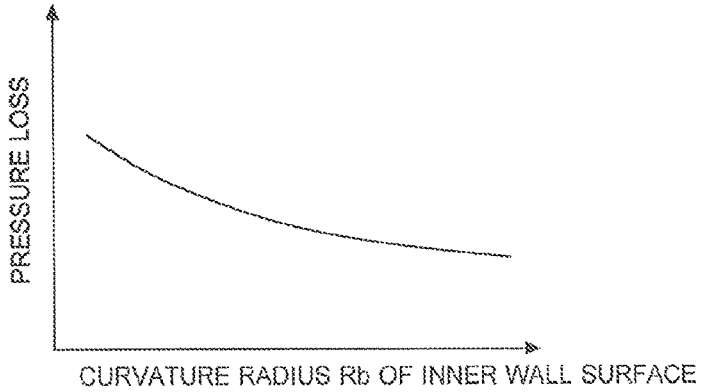
FIG. 5 is a graph for showing a relationship between a curvature radius of an inner wall surface and the pressure loss.

FIG. 5 is a graph for showing a relationship between the curvature radius of the inner wall surface and the pressure loss.

As shown in FIG. 4 and FIG. 5, as the curvature radius Ra of the outer wall surface is larger, the generation of the vortex is further suppressed, thereby reducing the pressure loss occurring in the refrigerant passing through each of the first bending portion 23*f* and the second bending portion 23*g*. As the curvature radius Ra of the outer wall surface is smaller, on the other hand, the refrigerant is less easily caused to flow, thereby increasing the pressure loss occurring in the refrigerant passing through each of the first bending portion 23*f* and the second bending portion 23*g*. Further, as the curvature radius Rb of the inner wall surface is larger, the refrigerant is less easily separated from the wall surface to suppress the generation of the vortex, thereby reducing the pressure loss occurring in the refrigerant passing through each of the first bending portion 23*f* and the second bending portion 23*g*.

Therefore, when the curvature radius of the first bending portion 23*f* and the curvature radius of the second bending portion 23*g* are changed, the pressure loss occurring in the refrigerant flowing through the first outflow passage 23*d* and the pressure loss occurring in the refrigerant flowing through the second outflow passage 23*e* are changed. More refrigerant flows into a flow passage that is smaller in pressure loss, with the result that the ratio between the flow rate of the refrigerant passing through the first outflow passage 23*d* to flow out from the upper end portion 23*b* and the flow rate of the refrigerant passing through the second outflow passage 23*e* to flow out from the lower end portion 23*c* is changed. Thus, the distribution ratio of the respective flows of the refrigerant flowing out from the plurality of first outlet flow passages 11A is changed.

In the laminated header 2, the curvature radius of the first bending portion 23*f* and the curvature radius of the second bending portion 23*g* are actively set different from each other through good use of the above-mentioned phenomenon, thereby being capable of appropriately setting the distribution ratio of the respective flows of the refrigerant flowing out from the plurality of first outlet flow passages 11A. With the configuration in which the distribution ratio of the respective flows of the refrigerant flowing out from the plurality of first outlet flow passages 11A can be set, the refrigerant can be supplied to each of the first heat transfer tubes 4 of the heat exchanger 1 at an appropriate flow rate depending on heat load. Therefore, the heat exchange efficiency of the heat exchanger 1 can be enhanced.

Particularly when the refrigerant is in a two-phase gas-liquid state, liquid having higher density than gas is concentrated on the outer side of each of the first bending portion 23*f* and the second bending portion 23*g* due to a centrifugal force. Thus, compared to a case where the refrigerant is in a gas-phase state, the liquid easily stagnates in each of the first bending portion 23*f* and the second bending portion 23*g* so that the vortex is easily generated, thereby increasing the pressure loss. Therefore, when the refrigerant flowing into the laminated header 2 is in a two-phase gas-liquid state, it is more effective that the curvature radius of the first bending portion 23*f* and the curvature radius of the second bending portion 23*g* are set different from each other in realizing the above-mentioned setting of the distribution ratio.

Specifically, when the curvature radius Ra of the outer wall surface and the curvature radius Rb of the inner wall surface are increased, the pressure loss can be reduced to about ½. Further, the flow rate of the refrigerant is inversely proportional to the ½ power of the pressure loss, and hence, when the curvature radius Ra of the outer wall surface and the curvature radius Rb of the inner wall surface are increased or decreased, the flow rate of the refrigerant flowing out from each of the first outflow passage 23*d* and the second outflow passage 23*e* can be adjusted within a range of ±40%.

Further, the vortex generated in the region A significantly contributes to the pressure loss, and hence the ratio of the change of the pressure loss to the change of the curvature radius Ra of the outer wall surface is higher than the ratio of the change of the pressure loss to the change of the curvature radius Rb of the inner wall surface. Therefore, the change of the curvature radius Ra of the outer wall surface is more advantageous in the above-mentioned setting of the distribution ratio than the change of the curvature radius Rb of the inner wall surface.

Further, in the vicinity of the outer wall surface 23*fa* of the first bending portion 23*f*, which extends upward in the gravity direction, the refrigerant easily stagnates due to the influence of the gravity. Therefore, the change of the curvature radius of the first bending portion 23*f* is more advantageous in the above-mentioned setting of the distribution ratio than the change of the curvature radius of the second bending portion 23*g*.

Note that, in the above-mentioned setting of the distribution ratio, the flow rates of the respective flows of the refrigerant flowing out from the plurality of first outlet flow passages 11A may be kept non-uniform or kept uniform. For example, when the first outflow passage 23*d* and the second outflow passage 23*e* are shaped point-symmetric about the branching portion 23*a* and have the same surface properties, the flow rate of the refrigerant flowing out from the first outflow passage 23*d* is lower than the flow rate of the refrigerant flowing out from the second outflow passage 23*e* due to the influence of the gravity. When the curvature radius of the first bending portion 23*f* is changed so as to be larger than the curvature radius of the second bending portion 23*g*, however, the flow rates of the respective flows of the refrigerant flowing out from the plurality of first outlet flow passages 11A can be kept uniform. Depending on the shapes, the surface properties, or other factors of the first outflow passage 23*d* and the second outflow passage 23*e*, the curvature radius of the first bending portion 23*f* may be changed so as to be smaller than the curvature radius of the second bending portion 23*g*, to thereby keep uniform flow rates of the respective flows of the refrigerant flowing out from the plurality of first outlet flow passages 11A.

Further, the shape of the branching flow passage 12*b* is not limited to the above-mentioned shape, but may be any other shape as long as the pressure loss can be adjusted through the change of the curvature radius of the bending portion.

Figure 6:
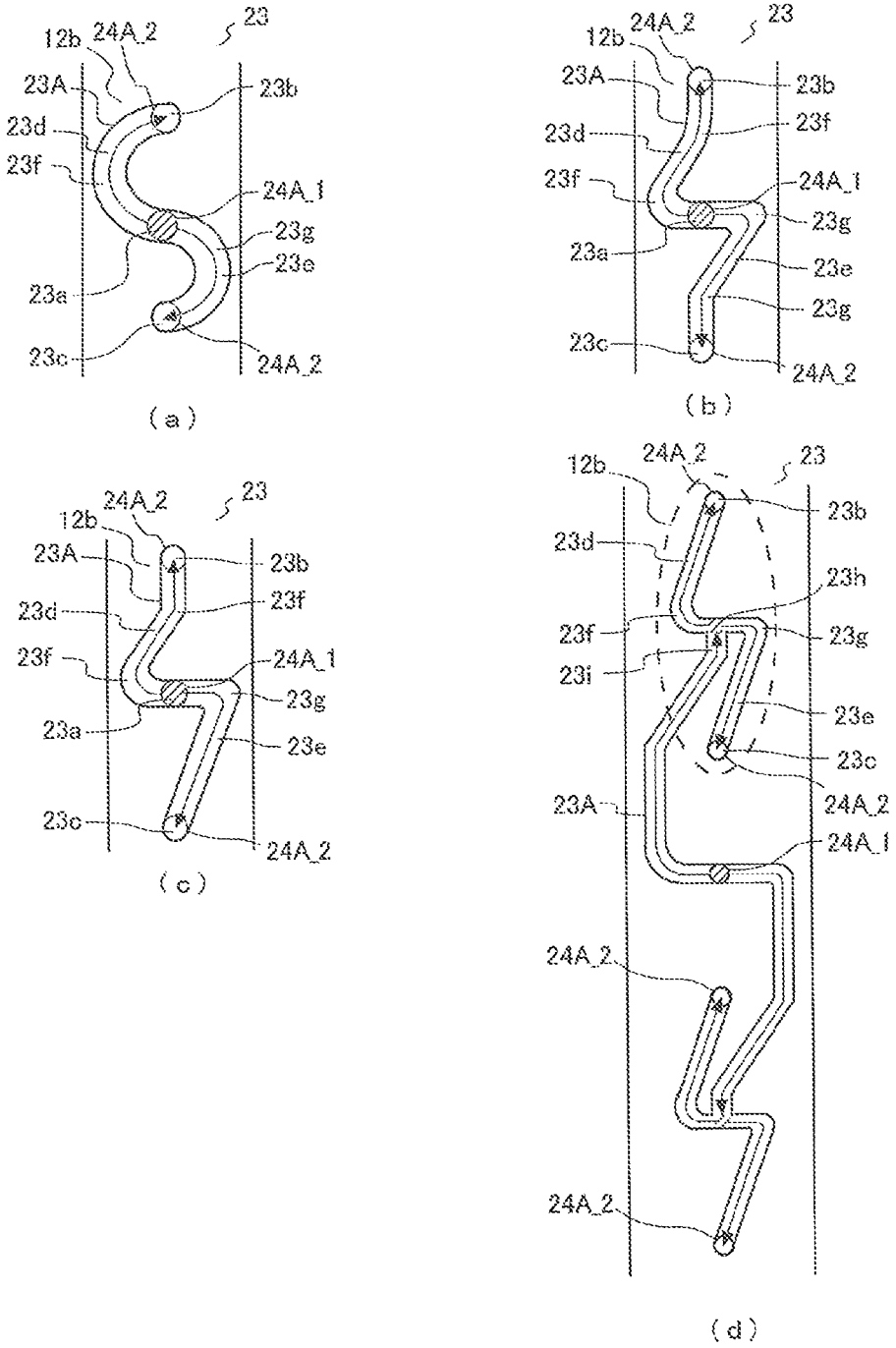
FIG. 6 are front views of modified examples of the periphery of the branching flow passage of the heat exchanger according to Embodiment 1.

FIG. 6 is a set of front views of modified examples of the periphery of the branching flow passage of the heat exchanger according to Embodiment 1.

For example, as illustrated in FIG. 6(*a*), the region in the flow passage 23A between the branching portion 23*a* and the first bending portion 23*f* or the region in the flow passage 23A between the branching portion 23*a* and the second bending portion 23*g* need not be formed into a straight line shape perpendicular to the gravity direction.

Further, for example, as illustrated in FIG. 6(*b*) and FIG. 6(*c*), a plurality of first bending portions 23*f* may be formed in the first outflow passage 23*d*, or a plurality of second bending portions 23*g* may be formed in the second outflow passage 23*e*. The number of first bending portions 23*f* and the number of second bending portions 23*g* may be equal or unequal to each other. When a plurality of first bending portions 23*f* and a plurality of second bending portions 23*g* are formed, it is only necessary that the curvature radius of the first bending portion 23*f* having the largest bending angle and the curvature radius of the second bending portion 23*g* having the largest bending angle be changed so as to be different from each other. As a matter of course, in conjunction with the above-mentioned change of the curvature radii, the curvature radius of another first bending portion 23*f* and the curvature radius of another second bending portion 23*g* may be changed so as to be different from each other. Alternatively, only the curvature radius of another first bending portion 23*f* and only the curvature radius of another second bending portion 23*g* may be changed so as to be different from each other. The pressure loss occurring at the bending portion having the largest bending angle significantly contributes to the pressure loss of the entire flow passage, and hence at least the curvature radius of the first bending portion 23*f* having the largest bending angle and the curvature radius of the second bending portion 23*g* having the largest bending angle are changed so as to be different from each other. Thus, the above-mentioned setting of the distribution ratio becomes advantageous.

Further, for example, as illustrated in FIG. 6(*d*), the flow passage 23A may include a branching portion 23*h* so that the refrigerant branched by flowing into the flow passage 23A is further branched at the branching portion 23*h*. That is, the branching flow passage 12*b* may branch the refrigerant passing through a flow passage 23*i* being a part of the flow passage 23A to flow into the branching flow passage 12*b* instead of the refrigerant passing through the flow passage 24A_1 to flow into the branching flow passage 12*b*. The branching portion 23*h* corresponds to a "branching portion" of the present invention. The flow passage 23*i* corresponds to the "inflow passage" of the present invention.

<Usage Mode of Heat Exchanger>

Now, an example of a usage mode of the heat exchanger according to Embodiment 1 is described.

Note that, in the following, there is described a case where the heat exchanger according to Embodiment 1 is used for an air-conditioning apparatus, but the present invention is not limited to such a case, and for example, the heat exchanger according to Embodiment 1 may be used for other refrigeration cycle apparatus including a refrigerant circuit. Further, there is described a case where the air-conditioning apparatus switches between a cooling operation and a heating operation, but the present invention is not limited to such a case, and the air-conditioning apparatus may perform only the cooling operation or the heating operation.

Figure 7:
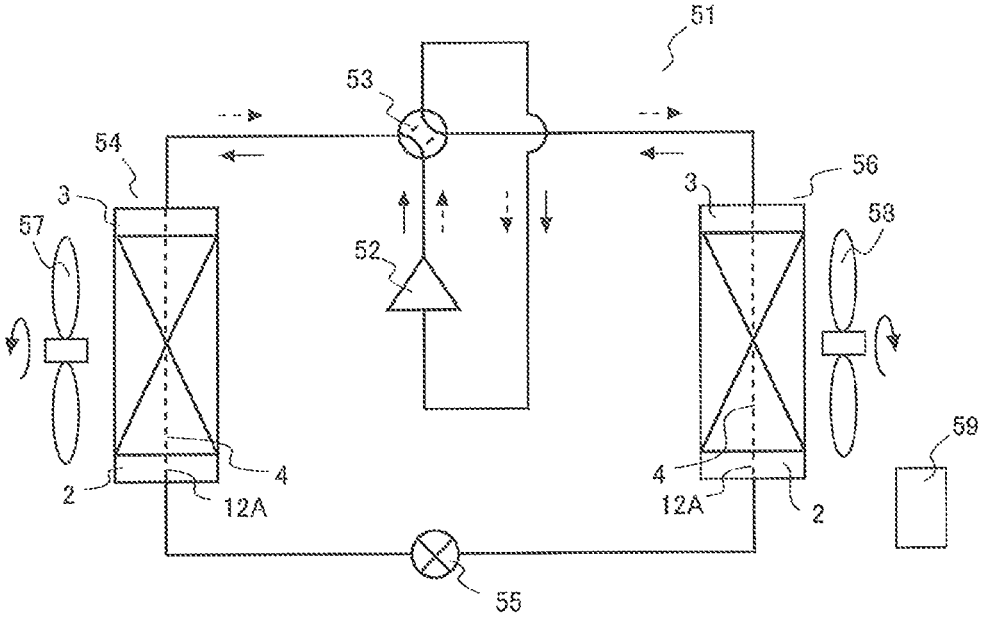
FIG. 7 is a diagram for illustrating a configuration of an air-conditioning apparatus to which the heat exchanger according to Embodiment 1 is applied.

FIG. 7 is a diagram for illustrating the configuration of the air-conditioning apparatus to which the heat exchanger according to Embodiment 1 is applied. Note that, in FIG. 7, the flow of the refrigerant during the cooling operation is indicated by the solid arrow, while the flow of the refrigerant during the heating operation is indicated by the dotted arrow.

As illustrated in FIG. 7, an air-conditioning apparatus 51 includes a compressor 52, a four-way valve 53, an outdoor heat exchanger (heat source-side heat exchanger) 54, an expansion device 55, an indoor heat exchanger (load-side heat exchanger) 56, an outdoor fan (heat source-side fan) 57, an indoor fan (load-side fan) 58, and a controller 59. The compressor 52, the four-way valve 53, the outdoor heat exchanger 54, the expansion device 55, and the indoor heat exchanger 56 are connected by refrigerant pipes to form a refrigerant circuit.

The controller 59 is connected to, for example, the compressor 52, the four-way valve 53, the expansion device 55, the outdoor fan 57, the indoor fan 58, and various sensors. The controller 59 switches the flow passage of the four-way valve 53 to switch between the cooling operation and the heating operation.

The flow of the refrigerant during the cooling operation is described.

The refrigerant in a high-pressure and high-temperature gas state discharged from the compressor 52 passes through the four-way valve 53 to flow into the outdoor heat exchanger 54, and is condensed through heat exchange with air supplied by the outdoor fan 57. The condensed refrigerant is brought into a high-pressure liquid state to flow out from the outdoor heat exchanger 54. The refrigerant is then brought into a low-pressure two-phase gas-liquid state by the expansion device 55. The refrigerant in the low-pressure two-phase gas-liquid state flows into the indoor heat exchanger 56, and is evaporated through heat exchange with air supplied by the indoor fan 58, to thereby cool the inside of a room. The evaporated refrigerant is brought into a low-pressure gas state to flow out from the indoor heat exchanger 56. The refrigerant then passes through the four-way valve 53 to be sucked into the compressor 52.

The flow of the refrigerant during the heating operation is described.

The refrigerant in a high-pressure and high-temperature gas state discharged from the compressor 52 passes through the four-way valve 53 to flow into the indoor heat exchanger 56, and is condensed through heat exchange with air supplied by the indoor fan 58, to thereby heat the inside of the room. The condensed refrigerant is brought into a high-pressure liquid state to flow out from the indoor heat exchanger 56. The refrigerant then turns into refrigerant in a low-pressure two-phase gas-liquid state by the expansion device 55. The refrigerant in the low-pressure two-phase gas-liquid state flows into the outdoor heat exchanger 54, and is evaporated through heat exchange with air supplied by the outdoor fan 57. The evaporated refrigerant is brought into a low-pressure gas state to flow out from the outdoor heat exchanger 54. The refrigerant then passes through the four-way valve 53 to be sucked into the compressor 52.

The heat exchanger 1 is used for at least one of the outdoor heat exchanger 54 or the indoor heat exchanger 56. When the heat exchanger 1 acts as the evaporator, the heat exchanger 1 is connected so that the refrigerant flows in from the laminated header 2 and the refrigerant flows out toward the header 3. In other words, when the heat exchanger 1 acts as the evaporator, the refrigerant in the two-phase gas-liquid state passes through the refrigerant pipe to flow into the laminated header 2. Further, when the heat exchanger 1 acts as the condenser, the refrigerant reversely flows through the laminated header 2.

<Actions of Heat Exchanger>

Now, actions of the heat exchanger according to Embodiment 1 are described.

The curvature radius of the first bending portion 23*f* formed in the first outflow passage 23*d* of the branching flow passage 12*b* and the curvature radius of the second bending portion 23*g* formed in the second outflow passage 23*e* of the branching flow passage 12*b* are different from each other, thereby appropriately setting the distribution ratio of the respective flows of the refrigerant flowing out from the plurality of first outlet flow passages 11A. Thus, the laminated header 2 can be used under a variety of situations, environments, or other conditions.

Further, the end portion of the first outflow passage 23*d* on the side communicated with the branching portion 23*a* and the end portion of the second outflow passage 23*e* on the side communicated with the branching portion 23*a* are perpendicular to the gravity direction, thereby suppressing errors in the distribution ratio that may be caused by the influence of the gravity.

Further, the branching flow passage 12*b* branches the refrigerant, which flows into the branching portion 23*a*, to the first outflow passage 23*d* and the second outflow passage 23*e*, that is, to the two outflow passages, and hence the causes of errors are reduced, thereby suppressing errors in the distribution ratio. Particularly when the first outflow passage 23*d* communicates the branching portion 23*a* and the upper end portion 23*b* positioned above the branching portion 23*a* in the gravity direction and the second outflow passage 23*e* communicates the branching portion 23*a* and the lower end portion 23*c* positioned below the branching portion 23*a* in the gravity direction, the distribution ratio of the respective flows of the refrigerant flowing out from the plurality of first outlet flow passages 11A may be changed due to the gravity. Therefore, it is more effective that the curvature radius of the first bending portion 23*f* formed in the first outflow passage 23*d* and the curvature radius of the second bending portion 23*g* formed in the second outflow passage 23*e* are set different from each other.

Further, the branching flow passage 12*b* is formed in such a manner that the region in the flow passage 23A formed in the third plate-like member 23 is closed by the members laminated adjacently, except for the refrigerant inflow region and the refrigerant outflow region. Thus, the above-mentioned setting of the distribution ratio can be realized without complicating the structure, thereby reducing the component cost, the number of manufacturing steps, and the like.

Further, the third plate-like members 23 are laminated through intermediation of the cladding member 24 so that the flow passage 24A formed in the cladding member 24 is connected to the flow passage 23A formed in each of the third plate-like members 23. Thus, the flow passage 24A functions as a refrigerant partitioning flow passage, thereby suppressing errors in the distribution ratio.

Embodiment 2

A heat exchanger according to Embodiment 2 is described.

Note that, overlapping description or similar description to that of Embodiment 1 is appropriately simplified or omitted.

<Configuration of Heat Exchanger>

Now, the configuration of the heat exchanger according to Embodiment 2 is described.

Figure 8:
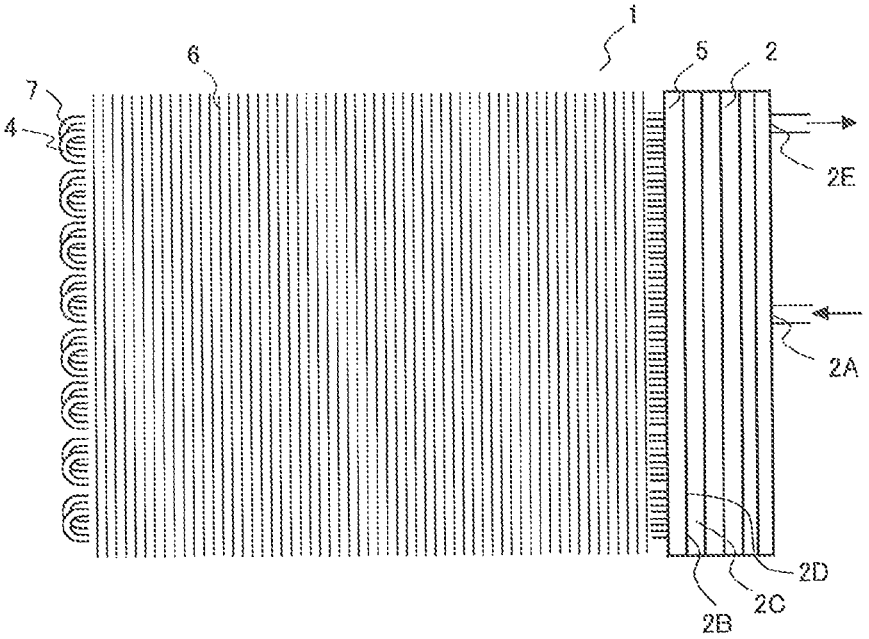
FIG. 8 is a view for illustrating a configuration of a heat exchanger according to Embodiment 2.

FIG. 8 is a view for illustrating the configuration of the heat exchanger according to Embodiment 2.

As illustrated in FIG. 8, the heat exchanger 1 includes the laminated header 2, the plurality of first heat transfer tubes 4, a plurality of second heat transfer tubes 7, the retaining member 5, and the plurality of fins 6.

The laminated header 2 includes the refrigerant inflow port 2A, the plurality of refrigerant outflow ports 2B, a plurality of refrigerant turn-back ports 2C, a plurality of refrigerant inflow ports 2D, and a refrigerant outflow port 2E. The refrigerant pipe is connected to the refrigerant outflow port 2E. Each of the first heat transfer tube 4 and the second heat transfer tube 7 is a flat tube subjected to hair-pin bending. The first heat transfer tubes 4 are connected between the refrigerant outflow ports 2B and the refrigerant turn-back ports 2C, and the second heat transfer tubes 7 are connected between the refrigerant turn-back ports 2C and the refrigerant outflow ports 2D.

<Flow of Refrigerant in Heat Exchanger>

Now, the flow of the refrigerant in the heat exchanger according to Embodiment 2 is described.

The flows of the refrigerant passing through the plurality of first heat transfer tubes 4 flow into the plurality of refrigerant turn-back ports 2C of the laminated header 2 to be turned back, and flow out therefrom toward the plurality of second heat transfer tubes 7. In each of the plurality of second heat transfer tubes 7, the refrigerant exchanges heat with, for example, air supplied by a fan. The flows of the refrigerant passing through the plurality of second heat transfer tubes 7 pass through the plurality of refrigerant inflow ports 2D to flow into the laminated header 2 to be joined, and the joined refrigerant passes through the refrigerant outflow port 2E to flow out therefrom toward the refrigerant pipe. The refrigerant can reversely flow.

<Configuration of Laminated Header>

Now, the configuration of the laminated header of the heat exchanger according to Embodiment 2 is described.

Figure 9:
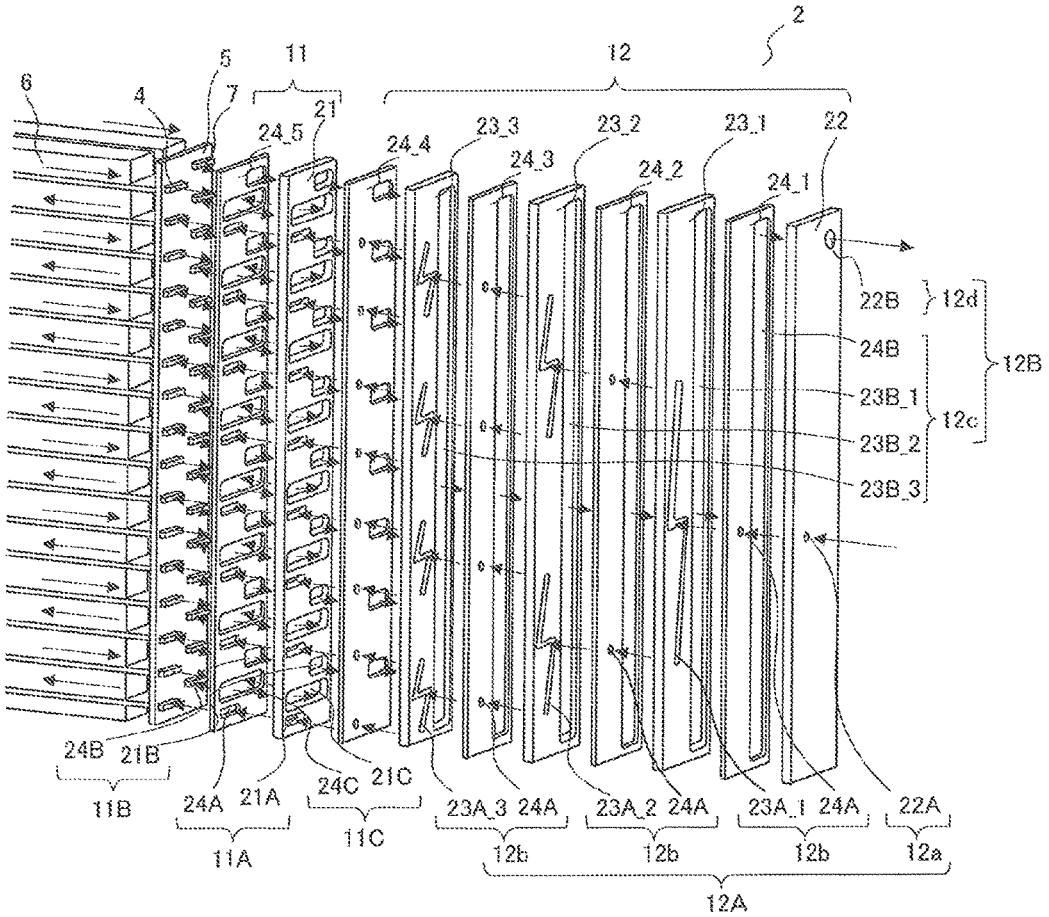
FIG. 9 is a perspective view for illustrating the heat exchanger according to Embodiment 2 under a state in which a laminated header is disassembled.

FIG. 9 is a perspective view of the heat exchanger according to Embodiment 2 under a state in which the laminated header is disassembled.

As illustrated in FIG. 9, a plurality of second inlet flow passages 11B are formed by flow passages 21B formed in the first plate-like member 21 and flow passages 24B formed in the cladding member 24_5. Each of the flow passages 21B and the flow passages 24B is a through hole having an inner peripheral surface shaped conforming to an outer peripheral surface of the second heat transfer tube 7. The plurality of second inlet flow passages 11B correspond to the plurality of refrigerant inflow ports 2D in FIG. 8.

A plurality of turn-back flow passages 11C are formed by flow passages 21C formed in the first plate-like member 21 and flow passages 24C formed in the cladding member 24_5. Each of the flow passages 21C and the flow passages 240 is a through hole having an inner peripheral surface shaped to surround the outer peripheral surface of the end portion of the first heat transfer tube 4 on the refrigerant outflow side and the outer peripheral surface of the end portion of the second heat transfer tube 7 on the refrigerant inflow side. The plurality of turn-back flow passages 110 correspond to the plurality of refrigerant turn-back ports 20 in FIG. 8.

A joining flow passage 12B is formed by a flow passage 22B formed in the second plate-like member 22, flow passages 23B_1 to 23B_3 formed in the third plate-like members 23_1 to 23_3, and flow passages 24B formed in the cladding members 24_1 to 24_4. The joining flow passage 12B includes a mixing flow passage 12*c* and a second outlet flow passage 12*d*.

The second outlet flow passage 12*d* is formed by the flow passage 22B formed in the second plate-like member 22. The flow passage 22B is a circular through hole. The refrigerant pipe is connected to the second outlet flow passage 12*d*. The second outlet flow passage 12*d* corresponds to the refrigerant outflow port 2E in FIG. 8.

The mixing flow passage 12*c* is formed by the flow passages 23B_1 to 23B_3 formed in the third plate-like members 23_1 to 23_3 and the flow passages 24B formed in the cladding members 24_1 to 24_4. Each of the flow passages 23B_1 to 23B_3 and the flow passages 24B is a rectangular through hole passing through a substantially entire region of the plate-like member in a height direction thereof.

Note that, a plurality of joining flow passages 12B may be formed in the second plate-like body 12, and each of the joining flow passages 12B may be connected to a part of the plurality of second inlet flow passages 11B formed in the first plate-like body 11. Further, the second outlet flow passage 12*d* may be formed in a plate-like member other than the second plate-like member 22. In other words, the present invention encompasses a case where the second outlet flow passage 12*d* is formed in the first plate-like body 11, and the "joining flow passage" of the present invention encompasses a joining flow passage other than the joining flow passage 12B having the second outlet flow passage 12*d* formed in the second plate-like body 12.

<Flow of Refrigerant in Laminated Header>

Now, the flow of the refrigerant in the laminated header of the heat exchanger according to Embodiment 2 is described.

The flows of the refrigerant passing through the plurality of first heat transfer tubes 4 flow into the plurality of turn-back flow passages 110 to be turned back, and flow into the plurality of second heat transfer tubes 7. The flows of the refrigerant passing through the plurality of second heat transfer tubes 7 pass through the plurality of second inlet flow passages 11B to flow into the mixing flow passage 12*c* to be mixed. The mixed refrigerant passes through the second outlet flow passage 12*d* to flow out therefrom toward the refrigerant pipe.

<Usage Mode of Heat Exchanger>

Now, an example of a usage mode of the heat exchanger according to Embodiment 2 is described.

Figure 10:
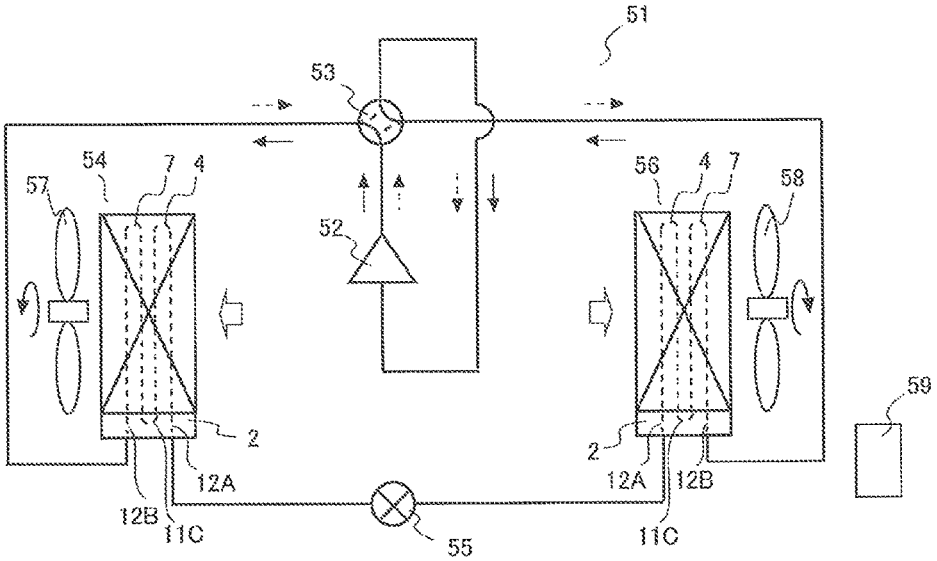
FIG. 10 is a diagram for illustrating a configuration of an air-conditioning apparatus to which the heat exchanger according to Embodiment 2 is applied.

FIG. 10 is a diagram for illustrating a configuration of an air-conditioning apparatus to which the heat exchanger according to Embodiment 2 is applied.

As illustrated in FIG. 10, the heat exchanger 1 is used for at least one of the outdoor heat exchanger 54 or the indoor heat exchanger 56. When the heat exchanger 1 acts as the evaporator, the heat exchanger 1 is connected so that the refrigerant passes through the distribution flow passage 12A of the laminated header 2 to flow into the first heat transfer tube 4, and the refrigerant passes through the second heat transfer tube 7 to flow into the joining flow passage 12B of the laminated header 2. In other words, when the heat exchanger 1 acts as the evaporator, the refrigerant in a two-phase gas-liquid state passes through the refrigerant pipe to flow into the distribution flow passage 12A of the laminated header 2. Further, when the heat exchanger 1 acts as the condenser, the refrigerant reversely flows through the laminated header 2.

<Actions of Heat Exchanger>

Now, actions of the heat exchanger according to Embodiment 2 are described.

The plurality of second inlet flow passages 11B are formed in the first plate-like body 11, whereas the joining flow passage 12B is formed in the second plate-like body 12. Therefore, the header 3 is eliminated, thereby being capable of reducing the component cost and the like of the heat exchanger 1. Further, the first heat transfer tube 4 and the second heat transfer tube 7 can be extended by an amount corresponding to the configuration in which the header 3 is eliminated, thereby being capable of increasing the number of fins 6 and the like, that is, increasing the mounting volume of the heat exchanging unit of the heat exchanger 1.

Further, the turn-back flow passage 110 is formed in the first plate-like body 11. Therefore, for example, the heat exchange amount can be increased without changing the area in a state of the front view of the heat exchanger 1.

The present invention has been described above with reference to Embodiment 1 and Embodiment 2, but the present invention is not limited to those embodiments. For example, a part or all of the respective embodiments may be combined.

Reference Signs List 1 heat exchanger2 laminated header 2A refrigerant inflow port 2B refrigerant outflow port 2C refrigerant turn-back port 2D refrigerant inflow port 2E refrigerant outflow port 3 header 3A refrigerant inflow port 3B refrigerant outflow port 4 first heat transfer tube5 retaining member 6 fin 7 second heat transfer tube 11 first plate-like body 11A first outlet flow passage 11B second inlet flow passage11C turn-back flow passage 12 second plate-like body 12A distribution flow passage 12B joining flow passage 12a first inlet flow passage 12b branching flow passage 12c mixing flow passage 12d second outlet flow passage 21 first plate-like member 21A-21C flow passage 22 second plate-like member 22A, 22B flow passage 23, 23_1-23_3 third plate-like member 23A, 23A_1-23A_3, 23B_1-23B_3 flow passage 23a branching portion 23b upper end portion 23c lower end portion 23d first outflow passage 23e second outflow passage 23f first bending portion23fa outer wall surface 23fb inner wall surface 23g second bending portion 23ga outer wall surface 23gb inner wall surface 23h branching portion 23i flow passage 24, 24_1-24_5 cladding member 24A-24C, 24A_1-24A_2 flow passage 51 air-conditioning apparatus 52 compressor 53 four-way valve 54 outdoor heat exchanger 55 expansion device 56 indoor heat exchanger 57 outdoor fan 58 indoor fan 59 controller

The invention claimed is:

1. A heat exchanger comprising:

a laminated header, a plurality of heat transfer tubes, each connected to one of a plurality of first outlet flow passages, the laminated header comprising:

a first plate-like body having the plurality of first outlet flow passages formed therein; and a second plate-like body attached to the first plate-like body in a direction perpendicular to a gravity direction and in a thickness direction of the first plate-like body, wherein the second plate-like body has a first inlet flow passage, the second plate-like body has at least a part of a distribution flow passage formed therein, the distribution flow passage is configured to distribute refrigerant passing through the first inlet flow passage to the second plate-like body, whereby the refrigerant is distributed to the plurality of first outlet flow passages, the distribution flow passage comprises at least one branching flow passage, the at least one branching flow passage comprises:

a branching portion, an inflow passage extending toward the branching portion, and a plurality of outflow passages extending from the branching portion in directions different from each other, at least two outflow passages of the plurality of outflow passages include a first outflow passage and at least one second outflow passage, the first outflow passage is different from the at least one second outflow passage, the first outflow passage has one bending portion or a plurality of bending portions formed therein, and the at least one second outflow passage has one bending portion or a plurality of bending portions formed therein, a curvature radius of the one bending portion formed in the first outflow passage or a curvature radius of a bending portion having a largest bending angle among the plurality of bending portions formed in the first outflow passage is different from a curvature radius of the one bending portion formed in the at least one second outflow passage or a curvature radius of a bending portion having a largest bending angle among the plurality of bending portions formed in the at least one second outflow passage, the at least two outflow passages comprise:

a first passage communicating with the branching portion, wherein the first passage comprises an end portion, and wherein the end portion is higher than the branching portion in height in a gravity direction, and a second passage communicating with the branching portion, wherein the second passage comprises an end portion, and wherein the end portion of the second passage is lower than the branching portion in height in a gravity direction, and the first passage and the second passage are opposite parts of a single continuous passage, and the single continuous passage is formed in a single plate-like member of the laminated header.

2. The heat exchanger of claim 1, wherein the curvature radius comprises a curvature radius of an outer wall surface of each of the plurality of outflow passages.

3. The heat exchanger of claim 1, wherein the curvature radius comprises a curvature radius of an inner wall surface of the each of the plurality of outflow passages.

4. The heat exchanger of claim 1, wherein the two outflow passages have their respective end portions at their respective sides communicating with the branching portion, and wherein their respective end portions extend in a direction perpendicular to a gravity direction.

5. The heat exchanger of claim 1, wherein the second plate-like body comprises at least one first plate-like member having a groove formed therein, and wherein the at least one branching flow passage is formed by closing a region in the groove other than a region where the refrigerant is caused to flow in and a region where the refrigerant is caused to flow out.

6. The heat exchanger of claim 5, wherein the at least one first plate-like member is laminated through intermediation of a second plate-like member having a brazing material applied to one or both surfaces of the second plate-like member, and wherein the second plate-like member has a through hole formed therein so as to communicate with any one of each of end portions of the groove and a part of the groove between the end portions.

7. The heat exchanger of claim 1, wherein the first plate-like body has a plurality of second inlet flow passages and a plurality of turn-back flow passages formed therein, each of the plurality of turn-back flow passages being configured to turn back the refrigerant, which flows into the first plate-like body, to thereby cause the refrigerant to flow out from the first plate-like body, and wherein the second plate-like body has at least a part of a joining flow passage formed therein, the joining flow passage being configured to join flows of the refrigerant, which pass through the plurality of second inlet flow passages to flow into the second plate-like body, to thereby cause the refrigerant to flow into a second outlet flow passage.

8. An air-conditioning apparatus, comprising the heat exchanger of claim 1, wherein the distribution flow passage is configured to cause the refrigerant to flow out from the distribution flow passage toward the plurality of first outlet flow passages when the heat exchanger serves as an evaporator.

* * * * *